US008833491B2

(12) United States Patent
Sonar et al.

(10) Patent No.: US 8,833,491 B2
(45) Date of Patent: Sep. 16, 2014

(54) DOWNHOLE ROTATIONAL LOCK MECHANISM

(71) Applicant: Halliburton Energy Services, Inc., Houston, TX (US)

(72) Inventors: Sandip Satish Sonar, Pune (IN); Ashish Prafulla Khaparde, Pune (IN); Dipender Ravindra Thakur, Pune (IN)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/236,200

(22) PCT Filed: Feb. 20, 2013

(86) PCT No.: PCT/US2013/026803

§ 371 (c)(1),
(2), (4) Date: Jan. 30, 2014

(65) Prior Publication Data

US 2014/0231144 A1 Aug. 21, 2014

(51) Int. Cl.
*E21B 4/20* (2006.01)
*E21B 4/00* (2006.01)

(52) U.S. Cl.
CPC ..... *E21B 4/006* (2013.01)
USPC ..... 175/101; 175/57; 175/92; 175/320; 166/240

(58) Field of Classification Search
USPC ..... 175/57, 101, 92, 320; 166/117.5, 242.6, 166/240; 192/69.81, 92, 93 A
See application file for complete search history.

(56) References Cited

U.S. PATENT DOCUMENTS

| | | | | |
|---|---|---|---|---|
| 1,727,276 | A | 9/1929 | Diehl | |
| 2,167,019 | A | 7/1939 | Yost | |
| 3,552,492 | A | 1/1971 | Mullins | |
| 3,964,558 | A | 6/1976 | Fogle | |
| 4,147,223 | A | 4/1979 | Patton | |
| 4,232,751 | A * | 11/1980 | Trzeciak | 175/101 |

(Continued)

FOREIGN PATENT DOCUMENTS

GB 2047778 A 12/1980

OTHER PUBLICATIONS

Authorized officer Choi Hyun Goo, International Search Report and Written Opinion in International Application No. PCT/US2013/026803, mailed on Oct. 18, 2013, 12 pages.

(Continued)

*Primary Examiner* — Kenneth L Thompson
*Assistant Examiner* — Taras P Bemko
(74) *Attorney, Agent, or Firm* — Anthony Iannitelli; Fish & Richardson P.C.

(57) ABSTRACT

The subject matter of this specification can be embodied in, among other things, a method that includes a downhole rotational lock mechanism including a tubular housing having a longitudinal bore with an internal wall. A driving gear is disposed in the longitudinal bore of the tubular housing and has a peripheral edge secured to the internal wall of the longitudinal bore of the tubular housing. The driving gear has an upper portion including a plurality of gear teeth arranged around a central longitudinal bore through the driving gear. A driven gear is movably disposed in the longitudinal bore of the tubular housing, and has a central longitudinal bore and a lower portion including a plurality of gear teeth. An output drive shaft is disposed longitudinally in the longitudinal bore of the tubular housing and in the longitudinal bore of the driven gear.

20 Claims, 4 Drawing Sheets

(56) References Cited

U.S. PATENT DOCUMENTS

| | | | | |
|---|---|---|---|---|
| 4,253,532 | A | | 3/1981 | Geczy |
| 4,295,535 | A | | 10/1981 | Crase et al. |
| 4,299,296 | A | * | 11/1981 | Geczy ..... 175/65 |
| 4,890,682 | A | | 1/1990 | Worrall et al. |
| 5,323,852 | A | | 6/1994 | Cornette et al. |
| 5,787,981 | A | * | 8/1998 | Taylor ..... 166/237 |
| 6,073,741 | A | | 6/2000 | Liu |
| 6,182,774 | B1 | | 2/2001 | Tibbits |
| 6,241,032 | B1 | | 6/2001 | Falgout, Sr. |
| RE38,498 | E | | 4/2004 | Ruth et al. |
| 6,745,836 | B2 | | 6/2004 | Taylor et al. |
| 6,796,414 | B2 | | 9/2004 | Hu et al. |
| 6,905,319 | B2 | | 6/2005 | Guo |
| 7,036,580 | B2 | | 5/2006 | McGarian et al. |
| 7,121,391 | B2 | | 10/2006 | Kuo |
| 7,178,611 | B2 | | 2/2007 | Zupanick |
| 7,377,337 | B2 | | 5/2008 | Swietlik et al. |
| 7,703,550 | B2 | | 4/2010 | Nevlud et al. |
| 7,735,581 | B2 | | 6/2010 | Beylotte et al. |
| 2004/0216273 | A1 | | 11/2004 | Kang et al. |
| 2004/0238219 | A1 | | 12/2004 | Nichols et al. |
| 2009/0195117 | A1 | | 8/2009 | Parmeter |

OTHER PUBLICATIONS

Kapoh et al., "New Locking Clutch Turbine Technology Successfully Frees Stuck Bit/BHA in Deep Gas Wells, Oman" SPE/IADC 144901, Oct. 24-26, 2011, 12 pages.

* cited by examiner 10
14
12
60
22
25
20
32
34
22
24
26
102
100
40
45
50

100
102
104
112
120
122
123
124
126
128
130
134
302
402
404
406

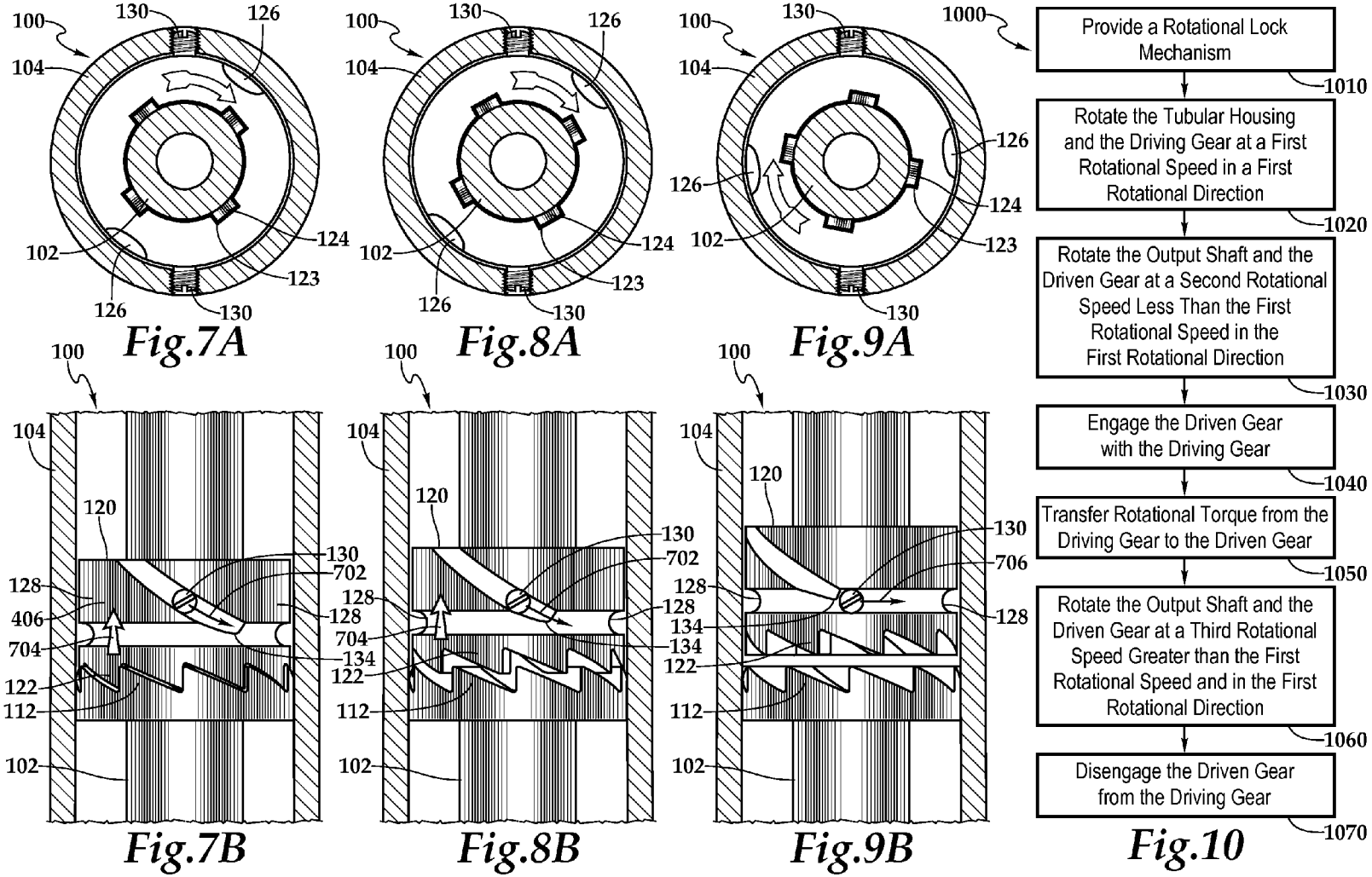
1000
Provide a Rotational Lock Mechanism
1010
Rotate the Tubular Housing and the Driving Gear at a First Rotational Speed in a First Rotational Direction
1020
Rotate the Output Shaft and the Driven Gear at a Second Rotational Speed Less Than the First Rotational Speed in the First Rotational Direction
1030
Engage the Driven Gear with the Driving Gear
1040
Transfer Rotational Torque from the Driving Gear to the Driven Gear
1050
Rotate the Output Shaft and the Driven Gear at a Third Rotational Speed Greater than the First Rotational Speed and in the First Rotational Direction
1060
Disengage the Driven Gear from the Driving Gear
1070
Fig.10
Fig.9A
Fig.9B
Fig.8A
Fig.8B
Fig.7A
Fig.7B

DOWNHOLE ROTATIONAL LOCK MECHANISM

TECHNICAL FIELD

The present disclosure relates to systems, assemblies, and methods for a downhole rotational lock mechanism for transmitting additional rotational torque to a tool string disposed in a wellbore, where adverse conditions may be present to challenge rotational movement of the tool string in the wellbore.

BACKGROUND

In oil and gas exploration it is important to protect the operational progress of the drill string and downhole tools connected thereto. In general, a drilling rig located at or above the surface may be coupled to a proximate end of a drill string in a wellbore to rotate the drill string. The drill string typically includes a power section (e.g., a positive displacement mud motor) that includes a stator and a rotor that are rotated and transfer torque down the borehole to a drill bit or other downhole equipment (referred to generally as the "tool string") coupled to a distal end of the drill string. The surface equipment on the drilling rig rotates the drill string and the drill bit as it bores into the Earth's crust to form a wellbore. During normal operation, the surface equipment rotates the stator, and the rotor is rotated due to a pumped fluid pressure difference across the power section relative to the stator. The rotational speed of downhole components, such as the drill string, power section, tool string, and drill bit, are commonly expressed in terms of revolutions per minute (RPM). As weight on the drill bit or formation resistance to drilling increases, the drill bit speed slows down. When the drill bit speed is equal to or less than the speed of the stator (as may be expressed in RPMs), the power section is referred to as "stalled."

DESCRIPTION OF DRAWINGS

FIGS. 3A-6B include top cross-sectional and side cross-sectional views of an example downhole rotational lock mechanism in various stages of engagement.

FIGS. 7A-9B show top cross-sectional and side cross-sectional views of an example downhole rotational lock mechanism in various stages of disengagement.

FIG. 10 is a flow diagram of an example process for providing rotational locking to transmit rotational torque to the downhole tool string.

DETAILED DESCRIPTION

Figure 1:
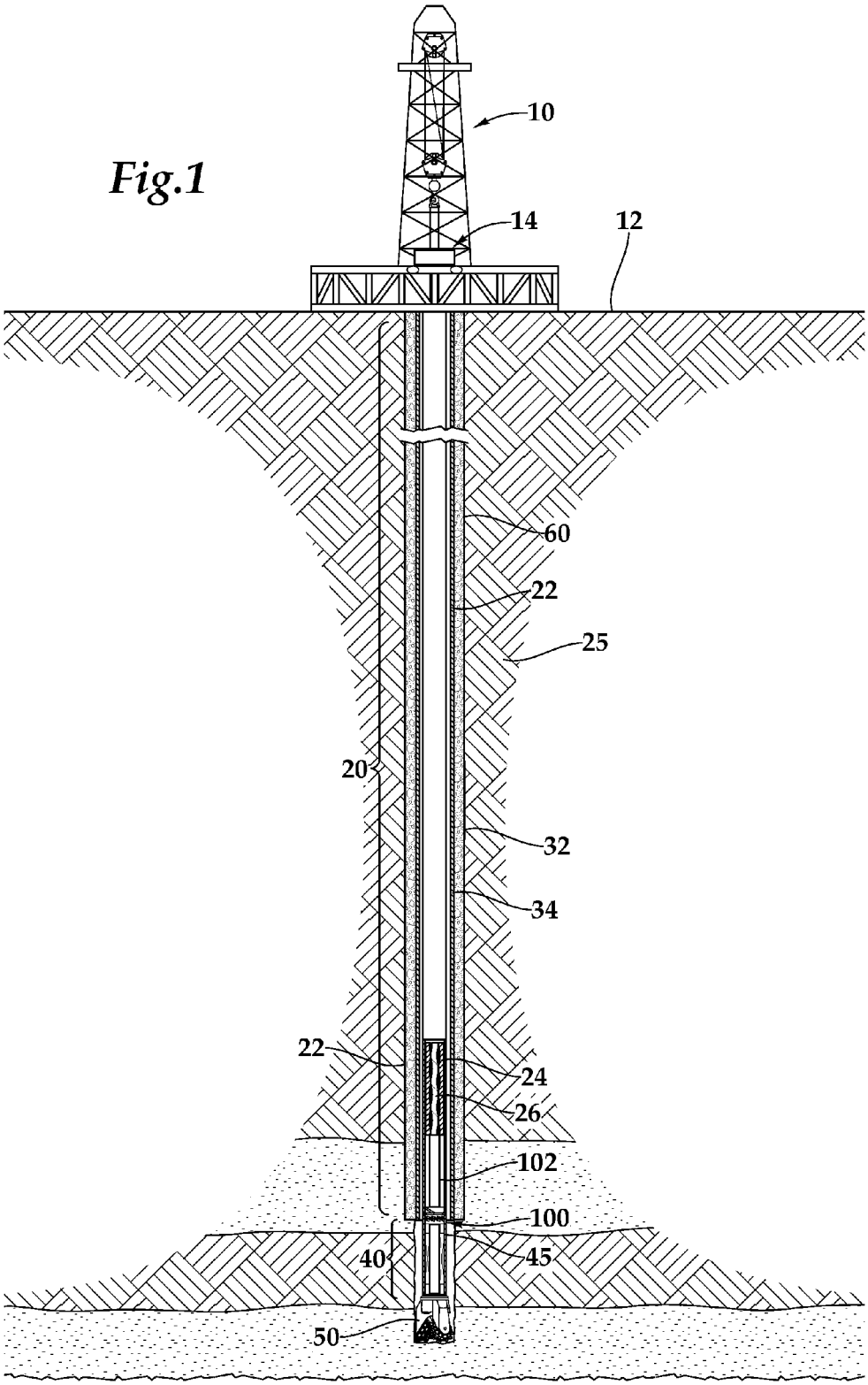
FIG. 1 is a schematic illustration of a drilling rig and downhole equipment including a rotational lock mechanism disposed in a wellbore.

Referring to FIG. 1, in general, a drilling rig 10 located at or above the surface 12 rotates a drill string 20 disposed in a wellbore 60 below the surface. The drill string 20 typically includes a power section 22 of a downhole positive displacement motor (e.g., a Moineau type motor), which includes a stator 24 and a rotor 26 that are rotated and transfer torque down the borehole to a drill bit 50 or other downhole equipment (referred to generally as the "tool string") 40 attached to a longitudinal output shaft 45 of the downhole positive displacement motor. The surface equipment 14 on the drilling rig rotates the drill string 20 and the drill bit 50 as it bores into the Earth's crust to form a wellbore 60. The wellbore 60 is reinforced by a casing 34 and a cement sheath 32 in the annulus between the casing 34 and the borehole. During the normal operation, the surface equipment 14 rotates the stator 24, and the rotor 26 is rotated due to a pumped fluid pressure difference across the power section 22 relative to the stator 24 of a downhole positive displacement motor. As weight on the drill bit 50 or formation resistance to drilling increases, and/or when the torque generated by the power section is insufficient to overcome this resistance, the drill bit 50 speed slows down. When the drill bit 50 speed is equal to or less than the stator 24 RPM, the power section 22 is referred to as "stalled."

At this stage the rotation of the drill bit 50 and the rotor 26 lags behind the rotation of the stator 24, which means the rotor 26 is turning relatively backward with respect to stator 24. During motor stall, the combination of mechanical loading and high pressure fluid erosion can quickly result in serious damage to the elastomer of the stator and can reduce the working life and efficiency of the power section 22.

Is some situations, motor stall may be avoided by providing additional torque to the drill bit 50 in order to cut through the formation that is causing the rotational resistance. In the illustrated example, a downhole rotational lock mechanism 100 is provided to transmit additional torque from the stator 24 to the drill bit 50.

Under normal operation, the stator 24 and the rotor 26 are substantially rotationally decoupled from each other. Under stall or near-stall conditions, the downhole rotational lock mechanism 100 engages to rotationally couple the stator 24 to an output drive shaft 102 that is driven by the rotor 26 to deliver additional torque to the longitudinal output shaft 45 which is removably secured to the output drive shaft. As resistance decreases, the downhole anti-rotation tool disengages to substantially decouple the stator 24 from the rotor 26.

Figure 2B:
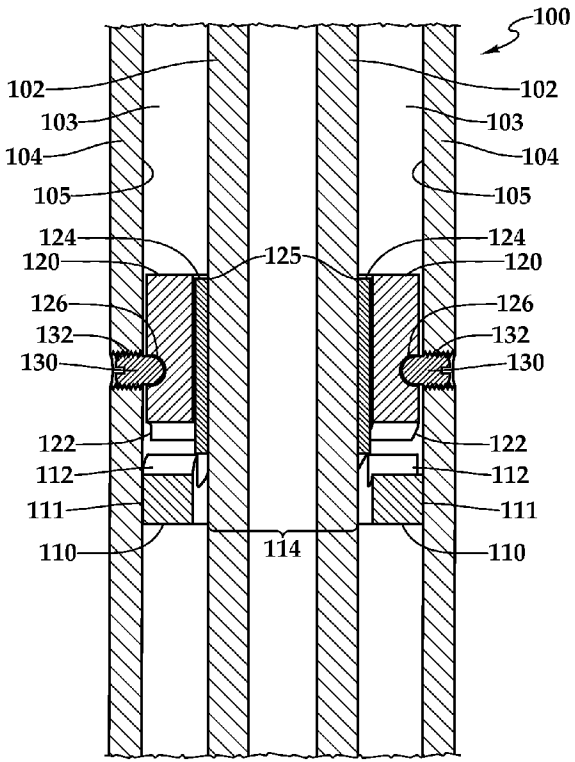
FIG. 2B is another, cross-sectional view of the example downhole rotational lock mechanism of FIG. 2A.
Figure 2A:
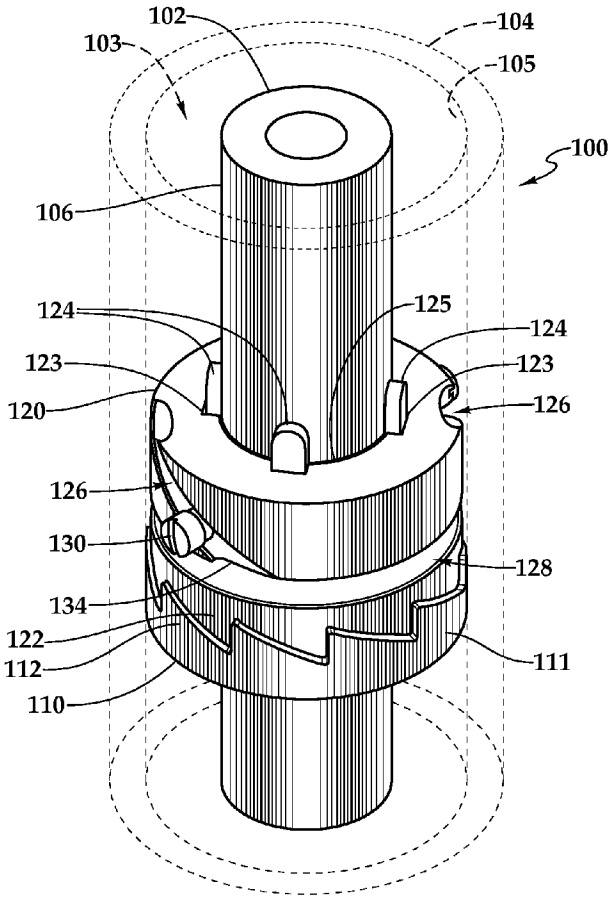
FIG. 2A is a partial perspective view of an example downhole rotational lock mechanism.

FIGS. 2A and 2B show a partial perspective and cross-sectional view of an example downhole rotational lock mechanism 100. The mechanism 100 includes the output drive shaft 102 and a tubular housing 104. The tubular housing includes a longitudinal bore 103 and an internal wall 105. The output drive shaft 102 can be driven by the rotor 26 of FIG. 1, and the tubular housing 104 can be coupled to and driven by the stator 24.

A driving gear 110 is located in the longitudinal bore 103 circumferentially between the output drive shaft 102 and the tubular housing 104. The driving gear 110 includes a peripheral edge 111 secured to the internal wall 105 of the longitudinal bore 103. The driving gear 110 rotates along with the tubular housing 104, and is individually not coupled to rotation of the output drive shaft 102. The driving gear 110 includes saw tooth configured "gear teeth" 112 cut circumferentially in a pattern of saw-tooth ratchets disposed around a central longitudinal bore 114 through the driving gear 110.

A driven gear 120 is located in the longitudinal bore 103 circumferentially between the output drive shaft 102 and the tubular housing 104. A lower surface of the driven gear 120 includes gear teeth 122 cut circumferentially in a pattern of saw-tooth ratchets that correspond to and can mate with the gear teeth 112. The driven gear 120 includes one or more longitudinal grooves 123 disposed axially in the internal wall 125 of the longitudinal bore 114 of the driven gear 120 to receive one or more splines 124 adapted to allow the driven gear to slide longitudinally on the output shaft 102. The splines 124 are oriented longitudinally about an outer peripheral surface 106 of the output drive shaft 102 and received in mating longitudinal grooves 123 in internal wall of the bore of the driven gear 120, such that the driven gear 120 is able to slide longitudinally along the output drive shaft 102, and the splines 124 transmit rotational torque from the driven gear 120 to the output shaft 102.

In some implementations, the splines 124 may be formed, e.g., machined or molded, as part of the output drive shaft 102. In some implementations, the splines 124 may be removably connected to the output drive shaft 102. For example, the splines 124 may be formed as strips that are longitudinally affixed to the drive shaft by fasteners, welds, or any other appropriate connectors. In some implementations, the splines 124 may be formed as one or more locking keys, and the longitudinal grooves 123 may be one or more corresponding keyways formed to accept the locking keys. For example, the output drive shaft 102 may include one, two, three, four, or any other appropriate number of locking keys and the driven gear 120 may include a corresponding number of keyways. In some implementations, the splines 124 may be formed as a collection of longitudinal ribs that substantially surround the periphery of the output drive shaft 120, and the longitudinal grooves 123 may be formed as a collection of corresponding grooves formed in substantially the entire internal wall 105 of the longitudinal bore 103 driven gear 120. In some implementations, the splines 124 and the longitudinal grooves 123 may be substantially rectangular in cross-section. In some implementations, the splines 124 and the longitudinal grooves 123 may be substantially triangular in cross-section.

The driven gear 120 includes a collection of helical cam grooves 126 and a circumferential groove 128. The grooves 126-128 are formed to accept a collection of ball-end screws 130. The ball-end screws 130 are threaded through threads 132 formed in the tubular housing 104 to partly extend into the grooves 126-128.

The circumferential groove 128 is formed within and circumferentially about the radially outward surface of the driven gear 120. The circumferential groove 128 is formed such that the ball-end screws 130 pass within the circumferential groove 128 to allow the driven gear 120 to rotate freely while substantially maintaining the driven gear 120 at a position along the axis of the output drive shaft 102 such that the gear teeth 122 are disengaged from the gear teeth 112 of the driving gear 110.

The helical cam grooves 126 are formed within the radially outward surface of the driven gear 120, intersecting with the circumferential groove 128 at an intersection 134 and extending helically away from the circumferential groove 128 and gear teeth 122. The helical cam grooves 126 are formed such that the ball-end screws 130 pass within the helical cam grooves 126 to cause the driven gear 120 to move longitudinally along the splines 124 as the tubular housing 104 rotates relative to the output drive shaft 102. The longitudinal movement of the driven gear 120 causes the gear teeth 122 to engage the gear teeth 112 when the tubular housing 104 rotates relatively faster than the output drive shaft 102 in a first direction as shown in FIGS. 3A-6B, and causes the gear teeth 122 to disengage the gear teeth 112 when the tubular housing 104 rotates more slowly than the output drive shaft 102 as shown in FIGS. 3A-6B.

Figures 3A, 3B, 4A, 4B, 5A, 5B, 6A, 6B:
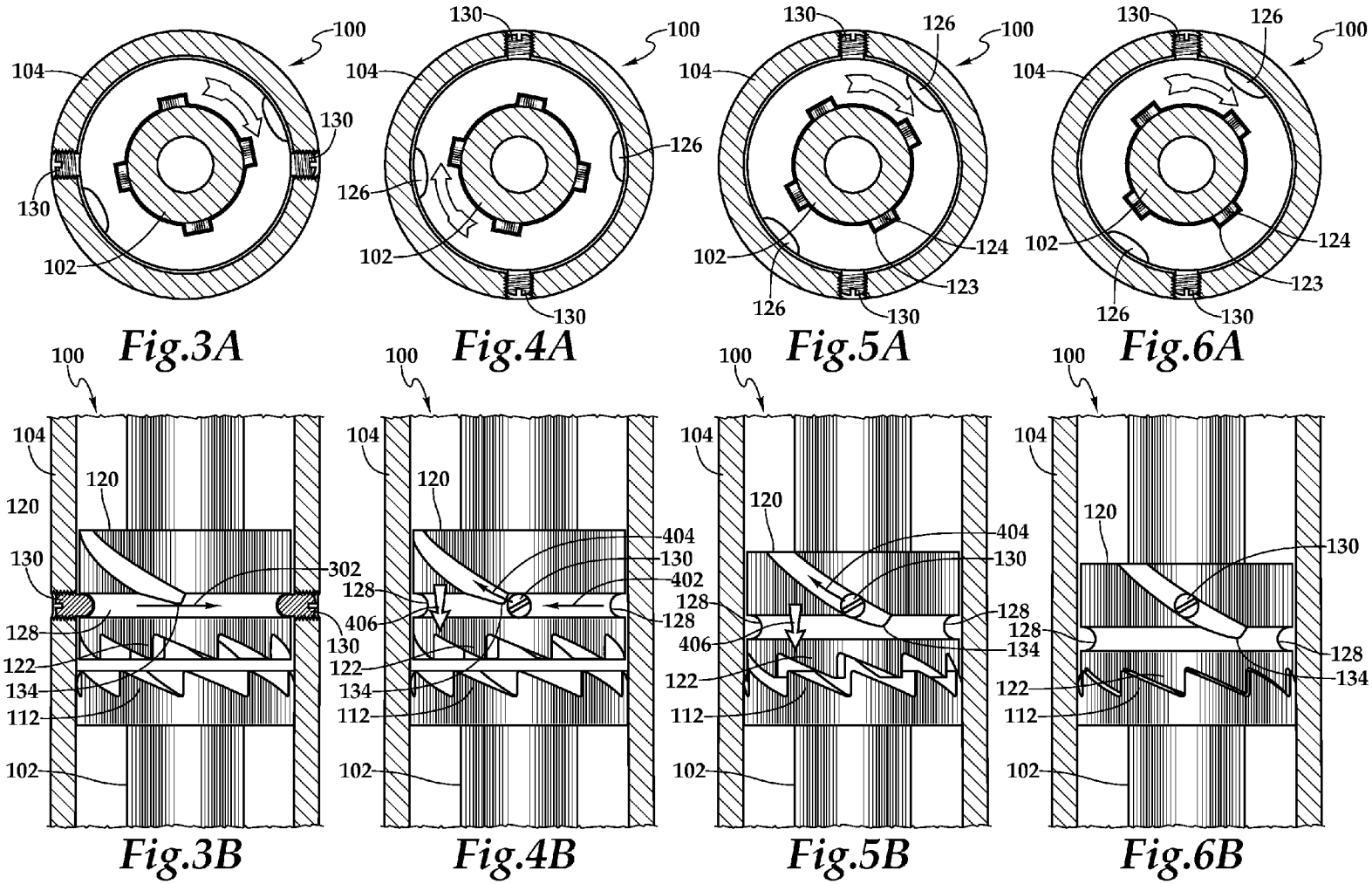

FIGS. 3A-6B show top cross-sectional and side cross-sectional views of the example downhole rotational lock mechanism 100 in various stages of engagement. Referring to FIGS. 3A and 3B, the mechanism 100 is shown in a disengaged configuration. In some implementations, the output shaft 102 can be adapted to transmit rotational torque to the drill bit 50 disposed in the wellbore 60 below the downhole rotational lock mechanism 100.

The gear teeth 122 of the driven gear 120 are not in rotational contact with the gear teeth 112 of the driving gear 110. Under normal operation, the output drive shaft 102 and the tubular housing 104 both rotate in the same direction, with the rotational speed of the output drive shaft 102 being relatively faster than that of the tubular housing 104. In the illustrated examples, the rotation of both members is shown as being clockwise as viewed from the perspective shown in FIG. 3A, but in some embodiments the mechanism 100 may be configured to perform substantially the same functions as will be described when the rotation is counterclockwise.

Under normal operation, the output drive shaft 102 rotates relatively faster than the tubular housing 104. The ball-end screws 130 travel along the groove 128 in a direction generally opposite that of the helical cam grooves 126 at the intersections 134, as indicated by arrow 302. In the view provided by FIG. 3B, this operation will cause the ball-end screws 130 to travel along the circumferential groove 128 from left to right. As such, the ball-end screws 130 will pass the intersections 134 and not substantially engage the helical cam grooves 126.

Referring now to FIGS. 4A and 4B, the relative rotation of the tubular housing 104 has begun rotating relatively faster than the output drive shaft 102. For example, the drill bit 50 of FIG. 1 may encounter unexpected resistance that can slow the drill bit's 50 rotation as well as the rotation of the output drive shaft 102. The tubular housing 104 may continue rotating at substantially its original speed, which in this example is now relatively faster than the output drive shaft 102. As such, the ball-end screw 130 will travel along the circumferential groove 128 in the direction generally indicated by arrow 402.

When the ball-end screw 130 reaches an intersection 134, the ball-end screw 130 will exit the circumferential groove 128 and travel up along the helical cam groove 126 as generally indicated by the arrow 404. Since the ball-end screw 130 is fixed relative to the tubular housing 104, the travel of the ball-end screw 130 along the helical cam groove 126 in the indicated direction will urge the driven gear 120 in the direction generally indicated by the arrow 406.

In some embodiments, the driven gear 120 can be urged toward the driving gear 110 by gravity. For example, in a vertical drilling operation, the driven gear 120 may be located above the driving gear 110, and the weight of the driven gear 120 may be sufficient to cause the ball-end screw 130 to initially enter the helical cam groove 126 while travelling in the direction 402.

In some embodiments, the driven gear 120 can be urged toward the driving gear 110 by a bias member (not shown), e.g., a spring, a taper disc, or any other appropriate source of bias. For example, in a horizontal drilling operation, the bias member can provide a force that is sufficient to cause the ball-end screw 130 to initially enter the helical cam groove 126 while travelling in the direction 402. Such a bias member can cause the driven gear 120 to always be pushed towards the driving gear 110, and cause the ball-end screw 130 to enter the helical cam groove 126 when the relative speed of driven gear 120 is negative with respect to the driving gear 110.

Referring now to FIGS. 5A and 5B, as the ball-end screw 130 travels up along the helical cam groove 126 as generally indicated by the arrow 404, the driven gear 120 continues to be urged further in the direction generally indicated by the arrow 406. As the driven gear 120 moves in the direction 404, the gear teeth 122 engage the gear teeth 112 of the driving gear 110.

Referring now to FIGS. 6A and 6B, the driven gear 120 is shown fully engaged with the driving gear 110. In such a configuration, rotation of the tubular housing 104 and the driving gear 110 will urge rotation of the driven gear 120 through the engagement of the gear teeth 112, 122. Rotation of the driven gear 120 will urge rotation of the output drive shaft 102 while gear teeth 112, 122 remain at least partly engaged.

FIGS. 7A-9B show top cross-sectional and side cross-sectional views of the example downhole rotational lock mechanism 100 in various stages of disengagement away from an engaged configuration. For example, the mechanism 100 may be placed in the engaged configuration shown in FIGS. 6A-6B when resistance to the drill bit 50 of FIG. 1 increases to a point at which the rotational speed of the tubular housing 104 exceeds that of the output drive shaft 102. FIGS. 7A-9B illustrate an example of the substantially reverse process that takes place when the rotational speed of the output drive shaft 102 exceeds that of the tubular housing 104, such as after increased resistance on the drill bit 50 has been overcome.

FIGS. 7A and 7B show the mechanism 100 in a substantially engaged configuration, similar to that shown in FIGS. 6A and 6B. However, in the examples of FIGS. 7A and 7B, the output drive shaft 102 has just begun to rotate faster than the tubular housing 104. As such, the ball-end screws 130 will be urged along the helical cam grooves 126 in a direction generally indicated by arrow 702. As the ball-end screws 130 will be urged along the helical cam grooves 126, the driven gear 120 is urged longitudinally away from the driving gear 110 in the direction generally indicated by arrow 704.

Referring now to FIGS. 8A and 8B, as the ball-end screws 130 continue to be urged along the helical cam grooves 126 in the direction 702, and the driven gear 120 continues to be urged away from the driving gear 110 in the direction 704, the gear teeth 122 become increasingly disengaged from the gear teeth 112. When the ball-end screws 130 reach the intersections 134, the ball-end screws 130 will exit the helical cam grooves 126 and enter the circumferential groove 128.

Referring now to FIGS. 9A and 9B, the mechanism 100 is shown in a disengaged configuration. The driven gear 120 is shown sufficiently longitudinally apart from the driving gear 110 such that the gear teeth 122 are disengaged from the gear teeth 112. The ball-end screw 130 travels along the circumferential groove 128 in the direction generally indicated by the arrow 706. While the ball-end screw 130 is within the circumferential groove 128, the driven gear 120 is held in the disengaged longitudinal position shown in FIG. 9B.

FIG. 10 is a flow diagram of an example process 1000 for providing anti-rotational locking. In some implementations, the process 1000 may describe the operation of the downhole rotational lock mechanism 100 of FIGS. 1-9B.

At 1010, a downhole rotational lock mechanism, such as the mechanism 100 is provided. The mechanism includes a tubular housing 104 having a longitudinal bore 103 with an internal wall 105. The mechanism 100 also includes a driving gear 110 disposed in the longitudinal bore 103 of the tubular housing 104, the gear has a peripheral edge secured to the internal wall 105 of the longitudinal bore 103 of the tubular housing 104, said driving gear having an upper portion including a first plurality of gear teeth 112 disposed around a central longitudinal bore through the driving gear. The mechanism 100 also includes a driven gear 120 movably disposed in the longitudinal bore 103 of the tubular housing 104, said gear having a central longitudinal bore, said driven gear having a lower portion including a second plurality of gear teeth 122. An output drive shaft 102 is disposed longitudinally in the longitudinal bore 103 of the tubular housing 104 and in the longitudinal bore of the driven gear 120.

At 1020, the tubular housing and the driving gear are rotated at a first rotational speed in a first rotational direction. For example, as shown in FIG. 3A, the tubular housing 104 is rotated clockwise.

At 1030, the output shaft and the driven gear are rotated at a second rotational speed less than the first rotational speed and in the first rotational direction. For example, as shown in FIG. 3A, the output shaft 102 is also rotated clockwise at a speed that is slower than the tubular housing 104.

At 1040, the driven gear is engaged with the driving gear. For example, the gear teeth 112 can mesh with the gear teeth 122, as shown in FIG. 5B.

In some implementations, the downhole rotational lock mechanism further includes a ball-end screw fixed to the tubular housing of the rotational lock mechanism, with the ball-end screw being disposed in a circular circumferential groove connected to a helical cam groove disposed on an outer cylindrical surface of the driven gear. For example, the ball-end screw 130 can travel substantially within the circumferential groove 128, which is connected to the helical cam grooves 126.

In some implementations, engaging the driven gear with the driving gear can include passing the ball-end screw from the circular circumferential groove to the helical cam groove, and rotating the output shaft and the driven gear at the second rotational speed less than the first rotational speed and in the first rotational direction to urge the ball-end screw along the helical cam groove to urge the driven gear longitudinally toward the driving gear such that the second plurality of gear teeth become rotationally engaged with the first plurality of gear teeth. For example, as discussed in the descriptions of FIGS. 3A-6B, the ball-end screw 130 passes from the circumferential groove 128 into the helical cam groove 126. Rotation of the tubular housing 104 urges the ball-end screws 130 along the helical cam grooves 126, which in turn urge the driven gear 120 toward contact with the driving gear 110.

At 1050, rotational torque is transferred from the driving gear to the driven gear. For example, as shown in FIGS. 6A-6B, the gear teeth 112 can transfer rotational energy to the gear teeth 122.

At 1060, the output shaft and the driven gear are rotated at a third rotational speed greater than the first rotational speed and in the first rotational direction. For example, as shown in FIGS. 7A, 8A, and 9A, the output shaft 102 is rotated clockwise at a speed that is greater than the clockwise rotational speed of the tubular housing 104. In some implementations, this situation may occur just after the drill bit 50 has overcome an unexpectedly resistive geologic formation.

At 1070, the driven gear is disengaged from the driving gear. For example, as discussed in the descriptions of FIGS. 7A-9B, the driven gear 120 becomes rotationally disengaged from the driving gear 110 as the driven gear 120 moves longitudinally away from the driving gear 110.

In some implementations, disengaging the driven gear from the driving gear can include rotating the output shaft and the driven gear at the third rotational speed less than the first rotational speed and in the first rotational direction urges the ball-end screw along the helical cam groove to urge the driven gear longitudinally away from the driving gear such that the second plurality of gear teeth become rotationally disengaged from the first plurality of gear teeth, and passing the ball-end screw from the helical cam groove to the circular circumferential groove. For example, FIGS. 7A-9B show the output shaft 102 rotating clockwise faster than the clockwise rotation of the tubular housing 104. The relative difference between the speeds of the driven gear 120 and the tubular housing 104 urges the ball-end screw 130 along the helical cam groove 126 toward the circumferential groove 128, which in turn urges the driven gear 120 longitudinally away from the driving gear 110. As the driven gear 120 moves away, the gear teeth 122 become rotationally disengaged from the gear teeth 112, which substantially stops the transfer of rotational energy from the driving gear 110 to the driven gear 120. The ball-end screw 130 eventually exits the helical cam groove 126 and enters the circumferential groove 128, as shown in FIGS. 9A-9B.

Although a few implementations have been described in detail above, other modifications are possible. For example, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A downhole rotational lock mechanism, comprising:

a tubular housing having a longitudinal bore with an internal wall;

a driving gear disposed in the longitudinal bore of the tubular housing, said driving gear having a peripheral edge secured to the internal wall of the longitudinal bore of the tubular housing, said driving gear having an upper portion including a plurality of gear teeth arranged around a central longitudinal bore through the driving gear;

a driven gear movably disposed in the longitudinal bore of the tubular housing, said driven gear having a central longitudinal bore, said driven gear having a lower portion including a plurality of gear teeth;

an output drive shaft disposed longitudinally in the longitudinal bore of the tubular housing and in the longitudinal bore of the driven gear; and a ball-end screw fixed to the tubular housing of the rotational lock mechanism, said ball-end screw being disposed in a circular circumferential groove disposed on an outer cylindrical surface of the driven gear and connected to a helical cam groove disposed on the outer cylindrical surface of the driven gear.

2. The mechanism of claim 1 wherein the output drive shaft includes at least one spline disposed on an outer peripheral surface of the output drive shaft, said spline received in a mating longitudinal groove in an inner surface of the central bore of the driven gear and the driven gear is slidable longitudinally on the output drive shaft.

3. The mechanism of claim 1 wherein the tubular housing is removably attached to a power output shaft of a downhole drilling motor disposed in a wellbore above the downhole rotational lock mechanism.

4. The mechanism of claim 1 wherein the output drive shaft of the rotational lock mechanism is coupled to a drill bit disposed in a wellbore below the downhole rotational lock mechanism.

5. The mechanism claim 1 wherein the gear teeth of the driven gear mate with the gear teeth of the driving gear.

6. The mechanism of claim 1 further including a bias member provided to urge the driven gear toward the driving gear.

7. A method for transmitting rotational torque to a downhole tool, comprising:

providing a downhole rotational lock mechanism, including a tubular housing having a longitudinal bore with an internal wall;

a driving gear disposed in the longitudinal bore of the tubular housing, said driving gear having a peripheral edge secured to the internal wall of the longitudinal bore of the tubular housing, said driving gear having an upper portion including a first plurality of gear teeth disposed around a central longitudinal bore through the driving gear;

a driven gear movably disposed in the longitudinal bore of the tubular housing, said gear having a central longitudinal bore, said driven gear having a lower portion including a second plurality of gear teeth;

an output drive shaft disposed longitudinally in the longitudinal bore of the tubular housing and in the longitudinal bore of the driven gear; and a ball-end screw fixed to the tubular housing of the rotational lock mechanism, said ball-end screw being disposed in a circular circumferential groove disposed on an outer cylindrical surface of the driven gear and connected to a helical cam groove disposed on the outer cylindrical surface of the driven gear;

rotating the tubular housing and the driving gear at a first rotational speed in a first rotational direction;

rotating the output shaft and the driven gear at a second rotational speed less than the first rotational speed and in the first rotational direction;

engaging the driven gear with the driving gear comprising:

passing the ball-end screw from the circular circumferential groove to the helical cam groove;

rotating the output shaft and the driven gear at the second rotational speed less than the first rotational speed and in the first rotational direction urging the ball-end screw along the helical cam groove and thereby urging the driven gear longitudinally toward the driving gear such that the second plurality of gear teeth become rotationally engaged with the first plurality of gear teeth; and transferring rotational torque from the driving gear to the driven gear.

8. The method of claim 7 wherein the driven gear slides longitudinally on the output drive shaft and disengages the driven gear from the driving gear.

9. The method of claim 7 wherein the output drive shaft includes one or more splines disposed on an outer peripheral surface of the output drive shaft.

10. The method of claim 9 further including transmitting rotational torque from the driven gear to the output shaft via engagement of the splines of the output drive shaft with longitudinal grooves of the driving gear.

11. The method of claim 7 further including receiving by the tubular housing of the downhole rotational lock mechanism torque from the output of a downhole drilling motor disposed in the wellbore above the downhole rotational lock mechanism.

12. The method of claim 7 further including transmitting rotational torque from the output drive shaft to a drill bit disposed in a wellbore below the downhole rotational lock mechanism.

13. The method of claim 7 wherein the mechanism further includes a bias member, and the method further includes providing a bias force to urge the driven gear toward the driving gear.

14. A method for transmitting rotational torque to a downhole tool, comprising:

providing a downhole rotational lock mechanism, including a tubular housing having a longitudinal bore with an internal wall;

a driving gear disposed in the longitudinal bore of the tubular housing, said driving gear having a peripheral edge secured to the internal wall of the longitudinal bore of the tubular housing, said driving gear having an upper portion including a first plurality of gear teeth disposed around a central longitudinal bore through the driving gear;

a driven gear movably disposed in the longitudinal bore of the tubular housing, said gear having a central longitudinal bore, said driven gear having a lower portion including a second plurality of gear teeth;

an output drive shaft disposed longitudinally in the longitudinal bore of the tubular housing and in the longitudinal bore of the driven gear; and a ball-end screw fixed to the tubular housing of the rotational lock mechanism, said ball-end screw being disposed in a circular circumferential groove disposed on an outer cylindrical surface of the driven gear and connected to a helical cam groove disposed on the outer cylindrical surface of the driven gear;

engaging the driven gear with the driving gear comprising:

rotating the tubular housing and the driving gear at a first rotational speed in a first rotational direction;

rotating the output shaft and the driven gear at a second rotational speed less than the first rotational speed and in the first rotational direction urging the ball-end screw along the helical cam groove and thereby urging the driven gear longitudinally toward the driving gear such that the second plurality of gear teeth will become rotationally engaged with the first plurality of gear teeth;

disengaging the driven gear from the driving gear comprising:

rotating the output shaft and the driven gear at a third rotational speed greater than the first rotational speed and in the first rotational direction urging the ball-end screw along the helical cam groove thereby urging the driven gear longitudinally away from the driving gear such that the second plurality of gear teeth become rotationally disengaged with the first plurality of gear teeth;

passing the ball-end screw from the helical cam groove to the circular circumferential groove; and discontinuing a transfer of rotational torque from the driving gear to the driven gear.

15. The method of claim 14 wherein the driven gear slides longitudinally on the output drive shaft and disengages the driven gear from the driving gear.

16. The method of claim 14 wherein the output drive shaft includes one or more splines disposed on an outer peripheral surface of the output drive shaft.

17. The method of claim 16 further including transmitting rotational torque from the driven gear to the output shaft via engagement of the splines of the output drive shaft with longitudinal grooves of the driving gear.

18. The method of claim 14 further including receiving by the tubular housing of the downhole rotational lock mechanism torque from the output of a downhole drilling motor disposed in a wellbore above the downhole rotational lock mechanism.

19. The method of claim 14 further including transmitting rotational torque from the output drive shaft to a drill bit disposed in a wellbore below the downhole rotational lock mechanism.

20. The method of claim 14 wherein the mechanism further includes a bias member, and the method further includes providing a bias force to urge the driven gear toward the driving gear.

* * * * *

UNITED STATES PATENT AND TRADEMARK OFFICE

CERTIFICATE OF CORRECTION

PATENT NO. : 8,833,491 B2
APPLICATION NO. : 14/236200
DATED : September 16, 2014
INVENTOR(S) : Sonar et al.

It is certified that error appears in the above-identified patent and that said Letters Patent is hereby corrected as shown below:

In the Claim

Column 7, Line 58, Claim 5, before “claim”, insert -- of --

Signed and Sealed this
Second Day of December, 2014

Michelle K. Lee

Michelle K. Lee
*Deputy Director of the United States Patent and Trademark Office*